US010206048B2

(12) United States Patent
Petersen et al.

(10) Patent No.: US 10,206,048 B2
(45) **Date of Patent: *Feb. 12, 2019**

(54) HEARING DEVICE COMPRISING A FEEDBACK DETECTOR

(71) Applicant: Oticon A/S, Smørum (DK)

(72) Inventors: Svend Oscar Petersen, Smørum (DK); Anders Thule, Smørum (DK); Meng Guo, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/386,976

(22) Filed: Dec. 21, 2016

(65) Prior Publication Data

US 2017/0180879 A1 Jun. 22, 2017

(30) Foreign Application Priority Data

Dec. 22, 2015 (EP) ..... 15201835

(51) Int. Cl.
*H04R 25/00* (2006.01)

(52) U.S. Cl.
CPC ..... *H04R 25/453* (2013.01); *H04R 25/305* (2013.01); *H04R 25/407* (2013.01); (Continued)

(58) Field of Classification Search
CPC ..... H04R 25/45; H04R 25/453; H04R 3/02; H04R 2225/021
See application file for complete search history.

(56) References Cited

U.S. PATENT DOCUMENTS 4,525,856 A * 6/1985 Admiraal ..... H03G 3/3005 381/121
8,848,953 B2 * 9/2014 Pape ..... H04R 25/45 381/312

(Continued)

FOREIGN PATENT DOCUMENTS

EP 2 843 971 A1 3/2015
EP 2 999 234 A1 3/2016
WO WO 2015/007167 A1 1/2015

*Primary Examiner* — Matthew Eason
*Assistant Examiner* — Ryan Robinson
(74) *Attorney, Agent, or Firm* — Birch, Stewart, Kolasch & Birch, LLP

(57) ABSTRACT

The application relates to a hearing device comprising a) first and second input transducers for picking up sound signals from the environment and providing first and second electric input signals, b) a first and signal strength detectors for providing signal strength estimates of the first and second electric input signal, the first input transducer being located at or behind an ear of the user, and the second input transducer being located at or in an ear canal of the user. The hearing device further comprises c) a signal processing unit providing a processed signal based on the first and second electric input signals, and d) an output unit comprising an output transducer for converting the processed signal or a signal originating therefrom to a stimulus perceivable by said user as sound. The hearing device further comprises e) a feedback detector comprising e1) a comparison unit operationally coupled to the first and second signal strength detectors and configured to compare the signal strength estimates of the first and second electric input signals and to provide a signal strength comparison measure indicative of the difference between the signal strength estimates, and e2) a decision unit for providing a feedback measure indicative of current acoustic feedback from the output transducer to the first and/or second input transducers based on the (Continued)

comparison measure. In an embodiment, the feedback measure is used to control processing in the signal processing unit, e.g. a beamformer unit and/or a feedback cancellation system, and/or an amplification unit. The invention may e.g. be used in hearing aids, in particular hearing aids comprising an ITE-part adapted for being located at or in an ear canal of a user and a BTE-part adapted for being located at or behind an ear or the user.

17 Claims, 8 Drawing Sheets

(52) U.S. Cl.
CPC ..... *H04R 25/405* (2013.01); *H04R 25/606* (2013.01); *H04R 2225/021* (2013.01); *H04R 2225/025* (2013.01); *H04R 2225/67* (2013.01); *H04R 2410/05* (2013.01)

(56) References Cited

U.S. PATENT DOCUMENTS

| | | | | |
|---|---|---|---|---|
| 2007/0127757 | A2* | 6/2007 | Darbut | H04R 25/65 381/330 |
| 2009/0067651 | A1 | 3/2009 | Klinkby et al. | |
| 2010/0092016 | A1* | 4/2010 | Iwano | H04R 25/407 381/313 |
| 2015/0341730 | A1* | 11/2015 | Pedersen | H04R 25/407 381/322 |

* cited by examiner

HEARING DEVICE COMPRISING A FEEDBACK DETECTOR

SUMMARY

The present application relates to hearing devices, e.g. hearing aids. The disclosure relates specifically to a receiver-in-the-ear (RITE) type hearing device comprising a microphone system comprising a multitude (two or more) of microphones, wherein at least a first one of the microphones is adapted to be located at or in an ear canal of a user, and a second one of the microphones is adapted to be located a distance from the first one, e.g. at or behind an ear (pinna) of the user (or elsewhere). The present disclosure proposes a scheme for identifying dominant acoustic feedback from a receiver (loudspeaker) located in the ear canal to the microphone system. An embodiment of the disclosure provides a hearing aid with one or more microphones located behind the ear and with one or more microphones and a loudspeaker located in the ear canal.

Embodiments of the disclosure may e.g. be useful in applications such as hearing aids, in particular hearing aids comprising a second input transducer adapted for being located at or in an ear canal of a user and a first input transducer located elsewhere on the users' body, e.g. in a BTE-part adapted for being located at or behind an ear or the user.

An object of an embodiment of the present application is to detect situations in a hearing device where acoustic feedback is substantial or dominant. In particular, it is an object of embodiments of the disclosure to detect feedback in so-called open fittings, e.g. in a hearing device comprising a part (termed the ITE-part) adapted for being located in the ear canal of a user, wherein the ITE-part does not provide a seal towards the walls of the ear canal (e.g. in that it exhibits an open structure, such as in that it comprises an open dome structure (or an otherwise open structure with relatively low occlusion effect) to guide the placement of the ITE-part in the ear canal). It is a further object of embodiments of the disclosure to detect feedback in a hearing device comprising a mould intended to allow a relatively large sound pressure level to be delivered to the ear drum of the user (e.g. a user having a severe-to-profound hearing loss).

According to the present disclosure, a hearing device is provided. The hearing device comprises a first microphone located at or in an ear canal of a user, e.g. in or together with a speaker unit (also located in the ear canal), and a second microphone located behind an ear, e.g. in a BTE-part (BTE=behind-the-ear) of the hearing device. Such style is in the present application termed M2RITE (intended to indicate the presence of 2 microphones ('M2') in a receiver-in-the ear (RITE') type of hearing device). This results in a relatively large distance of 35-60 mm between the first and second microphone (cf. e.g. FIG. 4B). This is to be compared to the 7-14 mm of traditional BTE, RITE and ITE (in-the-ear) style hearing devices (cf. e.g. FIG. 4A). This results in a large difference in the acoustical feedback from the speaker in the ear canal to the two individual microphones. In conventional BTE or RITE style hearing devices, the feedback path to the two microphones is fairly similar, but in the M2RITE style the feedback to a (first) microphone located in a BTE-part is around 15-25 dB lower than the feedback to the (second) microphone located in the ear canal. In an embodiment, the M2RITE style hearing device (e.g. hearing aid) contains two input transducers (e.g. microphones), one located in or at the ear canal of a user and the other elsewhere at the ear of the user (e.g. behind the ear (pinna) of the user). In an embodiment, the hearing device (e.g. of M2RITE style) is configured to provide that the two input transducers are located along a substantially horizontal line when the hearing device is mounted at the ear of the user in a normal, operational state (cf. e.g. input transducers IN1, IN2 and line OL in FIG. 2A). This has the advantage of facilitating beamforming of the electric input signals from the input transducers in an appropriate direction, e.g. the 'look direction' of the user.

The acoustical feedback to the microphones located in the ear canal and at or behind the ear from a receiver located in the ear canal will be in the (acoustic) near-field range.

So, according to the present disclosure, if the level difference of a signal between the two microphones is less than a feedback difference threshold value, e.g. 15 dB, then the sound is not caused by feedback, and if the level difference is higher than the feedback difference threshold value, e.g. 15 dB, then it can be expected to be feedback.

In the conventional BTE, RITE or BTE this will not be possible to detect so clearly.

A Hearing Device Comprising a Feedback Detector:

In an aspect of the present application, an object of the application is achieved by a hearing device, e.g. a hearing aid, adapted for being arranged at least partly on a user's head or at least partly implanted in a user's head, the hearing device comprising

- an input unit for providing a multitude of electric input signals representing sound,
- a signal processing unit providing a processed signal based on one or more of said multitude of electric input signals, and
- an output unit comprising an output transducer for converting said processed signal or a signal originating therefrom to a stimulus perceivable by said user as sound;
- the input unit comprising
  - a first input transducer for picking up a sound signal from the environment and providing a first electric input signal, the first input transducer being located on the head, e.g. at or behind an ear, of the user;
  - a second input transducer for picking up a sound signal from the environment and providing a second electric input signal, the second input transducer being located at or in an ear canal of the user.
- The hearing device further comprises
- a feedback detector comprising
  - a first signal strength detector for providing a signal strength estimate of the first electric input signal, and
  - a second signal strength detector for providing a signal strength estimate of the second electric input signal,
  - a comparison unit operationally coupled to the first and second signal strength detectors and configured to compare the signal strength estimates of the first and second electric input signals and to provide a signal strength comparison measure indicative of the difference between said signal strength estimates;
  - a decision unit for providing a feedback measure indicative of current acoustic feedback from said output transducer to said first and/or second input transducer based on said signal strength comparison measure.

This has the advantage of improving feedback detection.

In an aspect, a hearing device comprising a feedback detector is provided.

In an embodiment, the feedback measure is implemented as a binary value (e.g. 0 or 1). In an embodiment, the feedback measure is implemented as a relative measure (e.g. between 0 and 1).

In an embodiment, the feedback measure is used to control processing in the signal processing unit, e.g. a beamformer unit and/or a feedback cancellation system, and/or an amplification system. In an embodiment, the feedback measure is used to control or influence a weighting unit for providing a weighted combination of a number of electric input signals representing a sound from the environment of the user wearing the hearing device. In an embodiment, the feedback measure, and/or the weights $w_i$ are frequency dependent. Thereby signal content of a resulting signal (being a weighted combination of the electric input signals) may be differently weighted at different frequencies. In an embodiment, the weighting unit provides a signal that is a linear combination of input signals $IN_i$ (i=1, . . . , M): $IN_1(k,m)*w_1(k,m)+ \ldots +IN_M(k,m)*w_M(k,m)$, where $w_i$. i=1, . . . , M, and M is the number of input transducers ($IT_i$), e.g. microphones, and thus corresponding electric input signals ($IN_i$), and where k and m are frequency and time indices, respectively. The weights $w_i$ are real or complex (and in general, time and frequency dependent) weights. The weighting unit may implement a selector (in which case the weights $w_i$ are binary, one of the weights being equal to is 1, and the others being equal to 0), or a mixer (in which case the weights $w_i$ are real and the sum of the weights is 1), or a beamformer filtering unit (in which case the weights $w_i$ are complex). In an embodiment, the feedback measure is used to determine the weights $w_i$.

In an embodiment, the attenuation of the acoustic propagation path of sound from the second to the first input transducer is determined for an acoustic source in the near-field, e.g. from the output transducer of the hearing device as reflected by the ear drum and leaked through the ear canal to the second input transducer. In an embodiment, the propagation distance between the output transducer (or the outlet from the output transducer) and the second input transducer is less than 0.05 m, such as less than 0.03 m, e.g. less than 0.02 m, such as less than 0.015 m. In an embodiment, the propagation distance between the second input transducer and the first input transducer is less than 0.3 m, such as less than 0.1 m, such as less than 0.08 m, e.g. less than 0.06 m, e.g. in the range between 0.02 and 0.1 m, e.g. in the range between 0.02 and 0.06 m. In an embodiment, the propagation distance between the second input transducer and the first input transducer is larger than 0.02 m, such as larger than 0.05 m, such as larger than 0.08 m, such as larger than 0.1 m, such as larger than 0.2 m.

The term 'signal strength' is taken to include signal level, signal power, and signal energy. In an embodiment, the signal strength detector comprises a level detector or a power spectrum detector. In an embodiment, 'signal strength' (e.g. at a specific frequency or range) refers to power spectrum density (e.g. at a specific frequency or range).

The first and second input transducers are intended to be located at the same ear of the user. In an embodiment, the first and second input transducers comprises first and second microphones, respectively.

In an embodiment, the first input transducer comprises (e.g. contains exactly) two input transducers.

In an embodiment, the hearing device comprises a BTE-part adapted to be worn at or behind an ear of a user, and an ITE-part adapted to be located at or in an ear canal of the user. In an embodiment, the first input transducer is located in the BTE-part. In an embodiment, the second input transducer is located in the ITE-part. In an embodiment, both 'first input transducers' are located in the BTE-part.

In an embodiment, the first input transducer is located in the BTE-part, and the second input transducer is located in the ITE-part.

In an embodiment, the hearing device comprises (e.g. consists of) two 'first input transducers' located in the BTE-part and one second input transducer located at or in an ear canal of the user, e.g. in the ITE-part.

In an embodiment, signal processing in the signal processing unit and/or in the feedback detector is performed in the time domain (on a broad band signal). In an embodiment, signal processing in the signal processing unit and/or in the feedback detector is performed in the time-frequency domain (in a number of frequency bands). In an embodiment, the signal processing in the signal processing unit is performed in the time-frequency domain, whereas the signal processing in the feedback detector is performed in the time domain (or in a smaller number of bands than in the signal processing unit). In an embodiment, the signal processing in the signal processing unit is performed in the time domain, whereas the signal processing in the feedback detector is performed in the time-frequency domain.

In an embodiment, the hearing device comprises a time to time-frequency conversion unit allowing the processing of signals in the (time-)frequency domain. In an embodiment, the time to time-frequency conversion unit comprises a filter bank or a Fourier transformation unit. In an embodiment, the comparison unit is configured to process the first and second electric input signal in a number of frequency bands. In an embodiment, the comparison unit is configured to only compare selected frequency bands, e.g. in correspondence with an acoustic transfer function from the second input transducer to the first input transducer. In an embodiment, the selected frequency bands are frequency bands that are estimated to be at risk of containing significant feedback, e.g. at risk of generating howl. In an embodiment, the selected frequency bands are predefined, e.g. determined in an adaptation procedure (e.g. a fitting session). In an embodiment, the selected frequency bands are dynamically determined, e.g. using a learning procedure (e.g. starting by considering all bands, and then limiting the comparison to bands where a significant level difference (e.g. above a predefined threshold level) is experienced over a predefined time period). In an embodiment, the feedback measure is provided in a number of frequency bands.

In an embodiment, the signal strength is taken to mean the magnitude (level) of the signal. In an embodiment, the decision unit is configured to apply a feedback difference threshold to make a binary distinction between a feedback dominant and non-feedback dominant acoustic situation. In an embodiment, a condition for concluding that a current acoustic situation is dominated by acoustic feedback is determined by the signal strength (e.g. the level or power or energy) of the second electric input signal being larger than the signal strength (e.g. the level or power or energy) of the first electric input signal AND the signal strength comparison measure indicative of the difference between the signal strength estimates being indicative of the difference being larger than the feedback difference threshold. In an embodiment, the feedback difference threshold is frequency dependent. In an embodiment, the feedback difference threshold is different in different frequency bands. The feedback difference threshold is preferably adapted in dependence on whether the signal strength is a level, a power or an energy. In an embodiment the feedback difference threshold is a threshold for the difference between the levels of the second and first electric input signals that discriminates between an acoustic situation with feedback (dominant feedback) and an acoustic situation with no feedback (not dominant feedback).

In an embodiment, the feedback difference threshold is predetermined. In an embodiment, the feedback threshold is determined during a fitting session, e.g. prior to the normal use of the hearing device. In an embodiment, the transfer function (e.g. the attenuation) of a sound source from the ear canal (e.g. the output transducer of the hearing device) from the second input transducer to the first input transducer is determined in an off-line procedure, e.g. during fitting of the hearing device to the specific user. In an embodiment, the transfer function from the second input transducer to the first input transducer is estimated in advance of the use of the hearing device, e.g. using an 'average head model', such as a head-and-torso simulator (e.g. Head and Torso Simulator (HATS) 4128C from Brüel & Kjæ Sound & Vibration Measurement A/S). In an embodiment, the transfer function from the second input transducer to the first input transducer is dynamically estimated. In an embodiment, the feedback difference threshold is between 5 dB and 25 dB. In an embodiment, the feedback difference threshold is adapted to represent a level difference between the first and second electric input signals. In an embodiment, the feedback difference threshold is between 15 dB and 25 dB. In an embodiment, the feedback difference threshold is larger than 15 dB, e.g. around 20 dB.

In an embodiment, the hearing device comprises a feedback cancellation system for reducing the acoustic or mechanical feedback from the output transducer to the first and/or second input transducer, and wherein the feedback measure indicative of the amount of acoustic feedback is used to control the feedback cancellation system. In an embodiment, the hearing device is configured to control an adaptation rate of an adaptive algorithm of the feedback cancellation system depending on the feedback measure. In an embodiment, the hearing device comprises a de-correlation unit for increasing a de-correlation between an output signal from the hearing device and an input signal to the hearing device (e.g. by introducing a small frequency shift, e.g. <20 Hz in the forward path of the hearing device). In an embodiment, the hearing device is configured to control the de-correlation unit (e.g. its activation or de-activation and/or the size of the frequency shift) depending on the feedback measure.

In an embodiment, the hearing device comprises a weighting unit comprising a mixer or a beamformer unit for providing a mixed or beamformed signal based on a weighted combination of said multitude of electric input signals or signals derived therefrom. In an embodiment, the weighting unit, e.g. the mixer or beamformer unit, is adapted to provide a weighted combination of the multitude of electric input signals. In an embodiment, one or more, such as all, of the weights is/are complex.

In an embodiment, the hearing device is configured to control the weighting unit, e.g. the mixer or beamformer unit, in dependence of the feedback measure. In an embodiment, one or more weights of the weighted combination of said multitude of electric input signals or signals derived therefrom is/are changed in dependence of the feedback measure. In an embodiment, the weights are changed to change an emphasis of the beamformer unit from one electric input signal to another in dependence of the feedback measure. In an embodiment, the weights of the beamformer unit are configured to emphasize the second electric input signal in case the feedback detector indicates that the current acoustic situation is NOT dominated by feedback. In an embodiment, the weights of the beamformer unit are configured to emphasize the first electric input signal(s) in case the feedback detector indicates that the current acoustic situation is dominated by feedback. In an embodiment, the hearing device is configured to change the weights of the beamformer unit to emphasize the first electric input signal(s) in the beamformed signal in case the feedback detector indicates that the current acoustic situation is dominated by feedback. In an embodiment, the hearing device is configured to change the weights of the beamformer unit from emphasizing the first electric input signal(s) towards emphasizing the second electric input signal in the beamformed signal in case the feedback detector changes its indication of the acoustic situation from being dominated by feedback to NOT being dominated by feedback.

In an embodiment, the hearing device is configured to control the beamformer unit to increase the weight of the first electric signal(s) in the beamformed signal in case the feedback difference indicates that the current acoustic situation is dominated by feedback. In an embodiment, the hearing device is configured to control the beamformer unit to increase the weight of the second electric signal in the beamformed signal in case the feedback difference indicates that the current acoustic situation is NOT dominated by feedback.

In an embodiment, the hearing device is configured to control the beamformer unit to increase the weight of the first electric signal(s) in the beamformed signal in frequency bands where the feedback difference indicates that the current acoustic situation is dominated by feedback. In an embodiment, the hearing device is configured to control the beamformer unit to decrease the weight of the second electric signal in the beamformed signal in frequency bands where the feedback difference indicates that the current acoustic situation is dominated by feedback. In an embodiment, the hearing device is configured to control the beamformer unit to increase the weight of the first electric signal(s) in the beamformed signal and to decrease the weight of the second electric signal in the beamformed signal in frequency bands where the feedback difference indicates that the current acoustic situation is dominated by feedback.

In an embodiment, the hearing device is configured to control the weighting unit (e.g. the mixer or the beamformer unit) to increase the weight of the first electric signal(s) and/or to decrease the weight of the second electric signal in the mixed or beamformed signal in frequency bands where the feedback difference indicates that the current acoustic situation is dominated by feedback.

In an embodiment, the signal processing unit is configured to take other measures than control of the beamformer unit in case of an indication by the feedback detector that the current acoustic situation is dominated by feedback. In an embodiment, such other measures may include changing a parameter of the feedback cancellation system, e.g. changing an adaptation rate of the adaptive algorithm and/or the application of a de-correlation (e.g. a frequency shift) to a signal of the forward path.

In an embodiment, the hearing device comprises a gain control unit. In an embodiment, the gain control unit form part of the signal processing unit. In an embodiment, the hearing device is configured to control the gain control unit in dependence of the feedback measure. In an embodiment, the gain control unit is configured to decrease the applied gain in case the feedback detector indicates that the current acoustic situation is dominated by feedback. In an embodiment, the hearing device comprises a gain control unit that is configured to allow separate gain regulation of the electric input signals from the different input transducers.

In an embodiment, the hearing device is configured to control a beamformer unit, a feedback cancellation system and/or a gain control unit according to a predefined criterion involving the feedback measure. In an embodiment, the predefined criterion involving the feedback measure comprises a lookup table of actions relating ranges of values of the feedback measure to actions related to the beamformer unit, the feedback cancellation system and the gain control unit.

In an embodiment, the hearing device comprises a hearing aid, a headset, an active ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the output unit is configured to provide a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises a wireless receiver for receiving a wireless signal comprising sound and for providing an electric input signal representing said sound. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device is or comprises a portable (typically battery driven) device. In an embodiment, the wireless link is a link based on (non-radiative) near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path between the input and output transducers. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples (e.g. corresponding to a frame length of 3.2 ms). Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of (e.g. uniform) frequency bands, where NI is e.g. larger than 5, such as larger than 10, such as larger than 50, such as larger than 100, such as larger than 500. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate (s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system or device comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In the present context, a SmartPhone (or similar device), may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

In an embodiment, the auxiliary device is another hearing device. In an embodiment, the hearing system comprises two hearing devices adapted to implement a binaural hearing system, e.g. a binaural hearing aid system.

Definitions

The 'near-field' of an acoustic source is a region close to the source where the sound pressure and acoustic particle velocity are not in phase (wave fronts are not parallel). In the near-field, acoustic intensity can vary greatly with distance (compared to the far-field). The near-field is generally taken to be limited to a distance from the source equal to about a wavelength of sound. The wavelength $\lambda$ of sound is given by $\lambda=c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output unit for providing an audible signal to the user in dependence on the processed audio signal. The signal processing unit may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain may be determined in a fitting process by a fitting system based on a user's hearing data, e.g. an audiogram, using a fitting rationale. The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
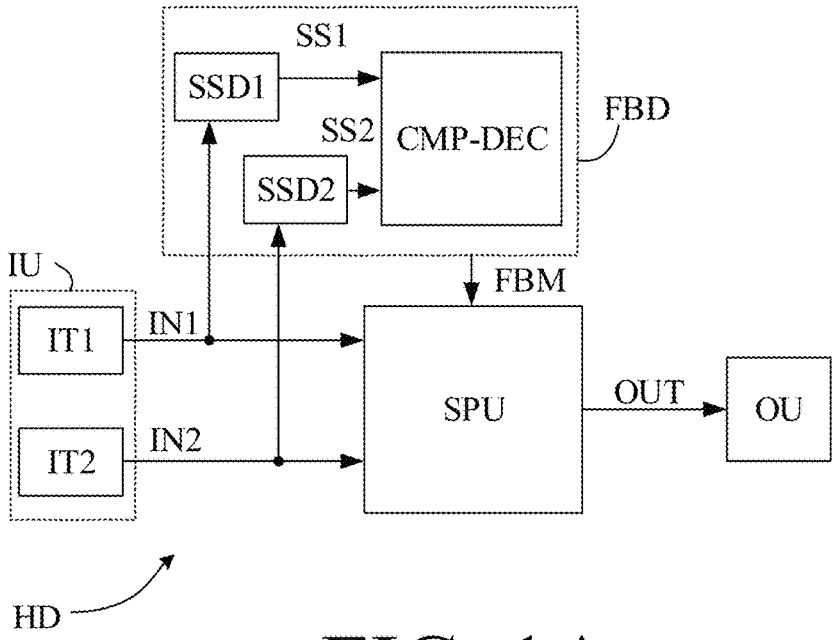
FIG. 1A shows a first embodiment of a hearing device according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

It is a general known problem for hearing aid users that acoustical feedback from the ear canal causes the hearing aid to whistle if the gain is too high and/or if the vent opening in the ear mould is too large. The more gain that is needed to compensate for the hearing loss, the smaller the vent (or effective vent area) must be to avoid whistle, and for severe hearing losses even the leakage between the ear mould (without any deliberate vent) and the ear canal can cause the whistling.

Hearing aids with microphones behind the ear can achieve the highest gain, due to their relatively large distance from the ear canal and vent in the mould. But for users with severe hearing loss needing high gain, it can be difficult to achieve a sufficient venting in the mould (with an acceptable howl risk).

An anti-feedback system may be designed to cancel out or attenuate the acoustical feedback. Such anti-feedback system (or 'feedback cancellation system') usually comprises some sort of howl- or tone-detection, and may act by suppressing the gain in case of a howl detection. Sometimes external sound are falsely identified as feedback howl, and then unintendedly suppressed. This may e.g. occur in the case of music (and be annoying to a listener).

EP2843971A1 deals with a hearing aid device comprising an "open fitting" providing ventilation, a receiver arranged in the ear canal, a directional microphone system comprising two microphones arranged in the ear canal at the same side of the receiver, and means for counteracting acoustic feedback on the basis of sound signals detected by the two microphones. An improved feedback reduction can thereby be achieved, while allowing a relatively large gain to be applied to the incoming signal.

FIG. 1A-1D shows four embodiments of a hearing device (HD) according to the present disclosure. Each of the embodiments of a hearing device (HD) comprises an input unit (IU; IUa, IUb) for providing a multitude (at least two) of electric input signals representing sound. The input unit comprises a first input transducer (IT1; IT11, IT12), e.g. a first microphone, for picking up a sound signal from the environment and providing a first electric input signal (IN1; IN11, IN12), and a second input transducer (IT2), e.g. a second microphone, for picking up a sound signal from the environment and providing a second electric input signal (IN2). The first input transducer (IT1; IT11, IT12) is adapted for being located behind an ear of a user (e.g. behind pinna, such as between pinna and the skull). The second input transducer (IT2) is adapted for being located in an ear of a user, e.g. near the entrance of an ear canal (e.g. at or in the ear canal or outside the ear canal but in the concha part of pinna). The hearing device (HD) further comprises a signal processing unit (SPU) for providing a processed signal (OUT) based (at least) on the first and/or second electric input signals (IN1 (IN11, IN12), IN2). The signal processing unit (SPU) may be located in a body-worn part (BW) e.g. located at an ear, but may alternatively be located elsewhere, e.g. in another hearing device, e.g. in an audio gateway device, in a remote control device, and/or in a SmartPhone. The hearing device (HD) further comprises an output unit (OU) comprising an output transducer (OT), e.g. a loudspeaker, for converting the processed signal (OUT) or a further processed version thereof to a stimulus perceivable by the user as sound. The output transducer (OT) is e.g. located in an in-the-ear part (ITE) of the hearing device adapted for being located in the ear of a user, e.g. in the ear canal of the user, e.g. as is customary in a RITE-type hearing device. The signal processing unit is located in the forward path between the input and output units (here operationally connected to the input transducers (IT1/IT11, IT12, IT2) and to the output transducer (OT)). A first aim of the location of the first and second input transducers is to allow them to pick up sound signals in the near-field leaking from the output transducer (OT), e.g. as reflected sound from the ear drum. A further aim of the location of the second input transducer is to allow it to pick up sound signals that include the cues resulting from the function of pinna (e.g. directional cues). The hearing device (HD) further comprises a feedback detector (FBD) comprising first and second detectors of signal strength (SSD1, SSD2) (e.g. level detectors) for providing estimates of signal strength (e.g. level estimates) of the first and second electric input signals. The a feedback detector (FBD) further comprises a comparison unit (CMP) operationally coupled to the first and second signal strength detectors (SSD1, SSD2) and configured to compare the signal strength estimates (SS1, SS2) of the first and second electric input signals (IN1, IN2) and to provide a signal strength comparison measure indicative of the difference (S2–S1) between the signal strength estimates (S1, S2). The feedback detector further comprises a decision unit (DEC) for providing a feedback measure based on the signal strength comparison measure. In the drawings the comparison and decision units (CMP, DEC) are shown as one integrated unit (CMP-DEC). The feedback measure (FBM) may e.g. be give a binary indication of the current acoustic environment of the hearing devices as 'dominated by acoustic feedback' or as 'not dominated by acoustic feedback'. Alternatively, the feedback measure (FBM) may be indicative of the amount of acoustic feedback from the output transducer to the first and/or second input transducer.

The embodiment of FIG. 1A comprises two input transducers (IT1, IT2). The number of input transducers may be larger than two ((IT1, . . . , ITn, n being any size that makes sense from a signal processing point of view), and may include input transducers of a mobile device, e.g. a SmartPhone or even fixedly installed input transducers (e.g. in a specific location, e.g. in a room) in communication with the signal processing unit).

Each of the input transducers of the input unit (IUa, IUb) can theoretically be of any kind, such as comprising a microphone (e.g. a normal microphone or a vibration sensing bone conduction microphone), or an accelerometer, or a wireless receiver. The embodiments of a hearing device (HD) of FIGS. 1C and 1D each comprises three input transducers (IT11, IT12, IT2) in the form of microphones (e.g. omni-directional microphones), two 'first' input transducers, e.g. microphones, (IT1, IT12) located on the head, e.g. at or behind an ear of the user, and one 'second' input transducer, e.g. a microphone, (IT2) located at or in an ear canal of the user.

Each of the embodiments of a hearing device (HD) comprises an output unit (OU) comprising an output transducer (OT) for converting a processed output signal to a stimulus perceivable by the user as sound. In the embodiments of a hearing device (HD) of FIGS. 1C and 1D, the output transducer is shown as receivers (loudspeakers). A receiver can e.g. be located in an ear canal (RITE-type (Receiver-In-The-ear) or a CIC (completely in the ear canal-type) hearing device) or outside the ear canal (e.g. a BTE-type hearing device), e.g. coupled to a sound propagating element (e.g. a tube) for guiding the output sound from the receiver to the ear canal of the user (e.g. via an ear mould located at or in the ear canal). Alternatively, other output transducers can be envisioned, e.g. a vibrator of a bone anchored hearing device.

The 'operational connections' between the functional elements signal processing unit (SPU), input transducers (IT1, IT2; IT11, IT12, IT2), and output transducer (OT)) of the hearing device (HD) can be implemented in any appropriate way allowing signals to the transferred (possibly exchanged) between the elements (at least to enable a forward path from the input transducers to the output transducer, via (and possibly in control of) the signal processing unit). The solid lines (denoted IN1, IN2, IN11, IN12, SS1, SS2, SS11, SS12, FBM, OUT) generally represent wired electric connections. The dashed zig-zag line (denoted WL in FIG. 1D) represent non-wired electric connections, e.g. wireless connections, e.g. based on electromagnetic signals, in which case the inclusion of relevant antenna and transceiver circuitry is implied). In other embodiments, one or more of the wired connections of the embodiments of FIG. 1A to 1D may be substituted by wireless connections using appropriate transceiver circuitry, e.g. to provide partition of the hearing device or system optimized to a particular application. One or more of the wireless links may be based on Bluetooth technology (e.g. Bluetooth Low-Energy or similar technology). Thereby a large bandwidth and a relatively large transmission range is provided. Alternatively or additionally, one or more of the wireless links may be based on near-field, e.g. capacitive or inductive, communication. The latter has the advantage of having a low power consumption.

The hearing device (here the signal processing unit) may e.g. further comprise a beamforming unit comprising a directional algorithm for providing an omni-directional signal or—in a particular DIR mode—a directional signal based on one or more of the electric input signals (IN1, IN2; or IN11, IN12, IN2). In such case, the signal processing unit (SPU) is configured to provide and further process a (spatially filtered) beamformed signal, and for providing a processed (preferably enhanced) output signal (OUT). In an embodiment, the feedback measure (FBM) is used as an input to the beamforming unit, e.g. to control or influence a mode of operation of the beamforming unit (e.g. between a directional and an omni-directional mode of operation, cf. e.g. FIG. 5A, 8A, 8B). The signal processing unit (SPU) may comprise a number of processing algorithms, e.g. a noise reduction algorithm, for enhancing the beamformed signal according to a user's needs to provide the processed output signal (OUT). The signal processing unit (SPU) may e.g. comprise a feedback cancellation system (e.g. comprising one or more adaptive filters for estimating a feedback path from the output transducer to one or more of the input transducers). In an embodiment, the feedback cancellation system may be configured to use the feedback measure (FBM) to activate a particular FEEDBACK mode where feedback above a predefined level is detected (e.g. in a particular frequency band or overall), cf. e.g. FIG. 5B, 6A, 6B. In the FEEDBACK mode, the feedback cancellation system is used to update estimates of the respective feedback path(s) and to subtract such estimate(s) from the respective input signal(s) (IN1, IN2; or In11, IN12, IN2) to thereby reduce (or cancel) the feedback contribution in the input signal(s). The feedback measure (FBM) may e.g. be used to control or influence an adaptation rate of an adaptive algorithm of the feedback cancellation system. The feedback measure (FBM) may e.g. be used to control or influence a de-correlation unit of the forward path, e.g. a frequency shift (on-off, or amount of frequency shift).

All embodiments of a hearing device are adapted for being arranged at least partly on a user's head or at least partly implanted in a user's head.

Figure 1B:
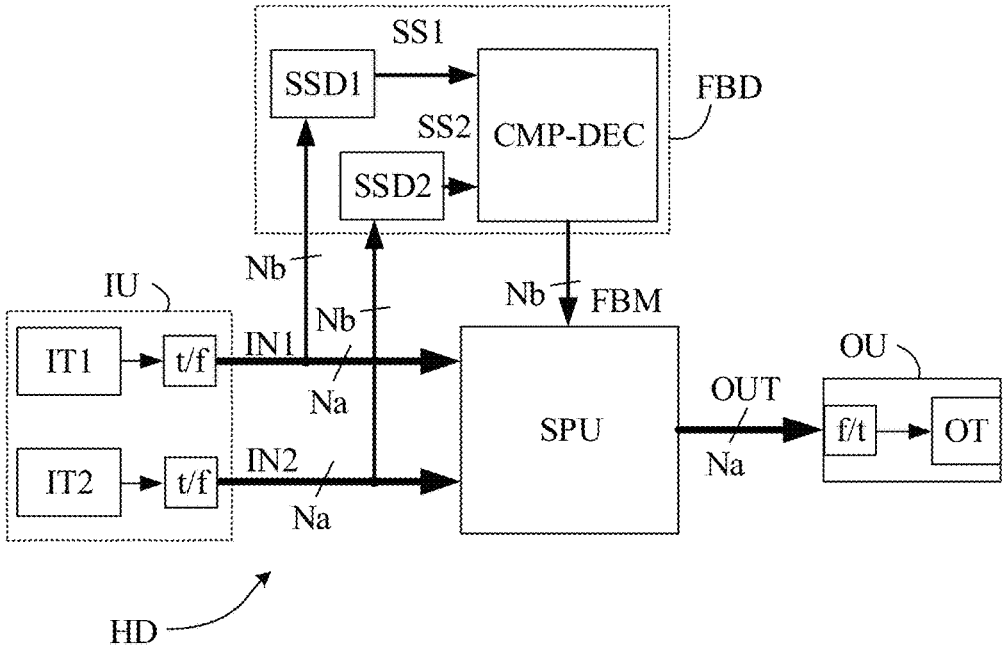
FIG. 1B shows a second embodiment of a hearing device according to the present disclosure.
Figure 1C:
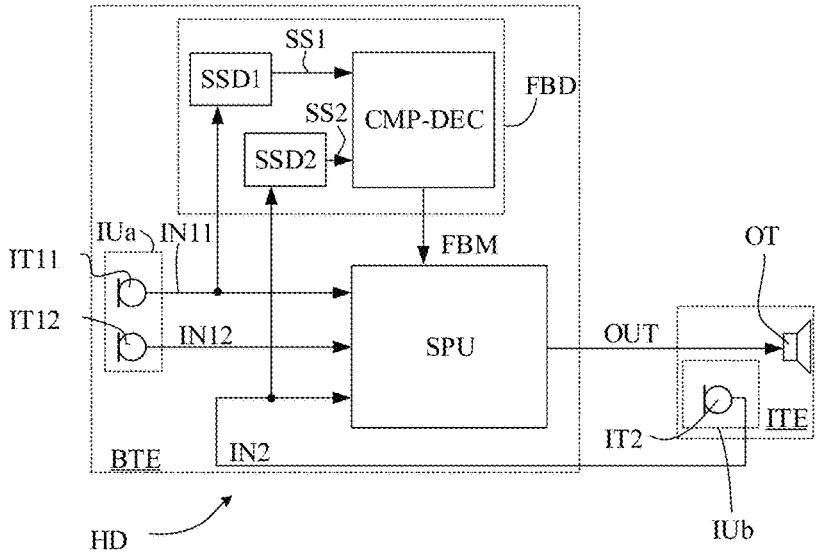
FIG. 1C shows a third embodiment of a hearing device according to the present disclosure.
Figure 1D:
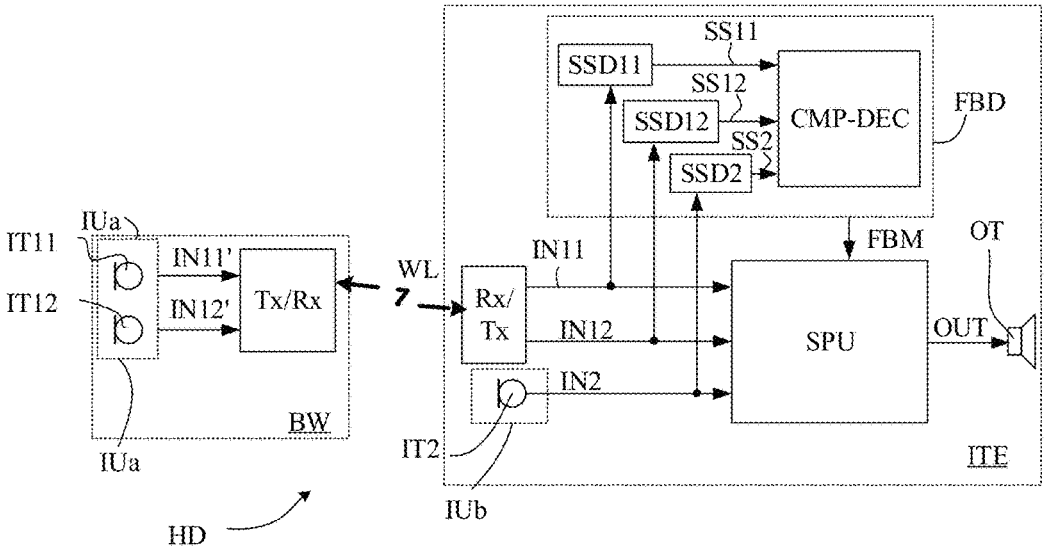
FIG. 1D shows a fourth embodiment of a hearing device according to the present disclosure.

FIGS. 1C and 1D are intended to illustrate different partitions of the hearing device of FIG. 1A, 1B. The following brief discussion of FIG. 1B to 1D is focused on the differences to the embodiment of FIG. 1A. Otherwise, reference is made to the above general description.

FIG. 1B shows an embodiment of a hearing device (HD) as shown in FIG. 1A, but including time-frequency conversion units (t/f) enabling analysis and/or processing of the electric input signals (IN1, IN2) from the input transducers (IT1, IT2, e.g. microphones), respectively, in the frequency domain. The time-frequency conversion units (t/f) are shown to be included in the input unit (IU), but may alternatively form part of the respective input transducers or in the signal processing unit (SPU) or be separate units. The hearing device (HD) further comprises a frequency to time transducer (f/t), shown to be included in the signal processing output unit (OU). Such functionality may alternatively be located elsewhere, e.g. in connection with the signal processing unit (SPU) or the output transducer (OT). The signals (IN1, IN2, OUT) of the forward path between the input and output units (IU, OU) are shown as bold lines and indicated to comprise Na (e.g. 16 or 64 or more) frequency bands (of uniform or different frequency width). The signals (IN1, IN2, SS1, SS2, FBM) of the analysis path are shown as semi-bold lines and indicated to comprise Nb (e.g. 4 or 16 or more) frequency bands (of uniform or different frequency width). Na and Nb may be equal or different according to system requirements (e.g. power consumption, necessary accuracy, etc.).

FIG. 1C shows an embodiment of a hearing device (HD) as shown in FIG. 1A or 1B, but the feedback detector (FBD) (signal strength detectors (SSD1, SSD2) and the comparison and decision unit (CMP-DEC)), and the signal processing unit (SPU) are located in a behind-the-ear part (BTE) together with input transducers (microphones IT11, IT12 forming part of input unit part IUa). The second input transducer (microphone IT2 forming part of input unit part IUb) is located in an in-the-ear part (ITE) together with the output transducer (loudspeaker OT forming part of output unit OU).

FIG. 1D illustrates an embodiment of a hearing device (HD), wherein the feedback detector (FBD) comprising signal strength detectors (SSD11, SSD12, SSD2), and comparison and decision units (CMP-DEC), and the signal processing unit (SPU) are located in the ITE-part, and wherein the input transducers (microphones (IT11, IT12) are located in a body worn part (BW) (e.g. a BTE-part) and connected to respective antenna and transceiver circuitry (together denoted Tx/Rx) for wirelessly transmitting the electric microphone signals IN11' and IN12' to the ITE-part via wireless link WL. The wireless connection (WL) may in another embodiment be substituted by a wired connection. Preferably, the body-worn part is adapted to be located at a place on the user's body that is attractive from a sound reception point of view, e.g. on the user's head. The ITE-part comprises the second input transducer (microphone IT2), and antenna and transceiver circuitry (together denoted Rx/Tx) for receiving the wirelessly transmitted electric microphone signals IN11' and IN12' from the BW-part (providing received signals IN11, IN12). The (first) electric input signals IN11, IN12, and the second electric input signal IN2 are connected to the signal unit (SPU). The signal processing unit (SPU) processes the electric input signals and provides a processed output signal (OUT), which is forwarded to output transducer OT and converted to an output sound. The wireless link WL between the BW- and ITE-parts may be based on any appropriate wireless technology. In an embodiment, the wireless link is based on an inductive (near-field) communication link. In a first embodiment, the BW-part and the ITE-part may each constitute self-supporting (independent) hearing devices. In a second embodiment, the ITE-part may constitute self-supporting (independent) hearing device, and the BW-part is an auxiliary device that is added to provide extra functionality. In an embodiment, the extra functionality may include one or more microphones of the BW-part to provide directionality and/or alternative input signal(s) to the ITE-part. In an embodiment, the extra functionality may include added connectivity, e.g. to provide wired or wireless connection to other devices, e.g. a partner microphone, a particular audio source (e.g. a telephone, a TV, or any other entertainment sound track). In the embodiment, of FIG. 1D, the signal strength (e.g. level/magnitude) of each of the electric input signals (IN11, IN12, IN2) is estimated by individual signal strength detectors (SSD11, SSD12, SSD2) and their outputs used in the comparison unit to determine a comparison measure indicative of the difference between said signal strength estimates. In an embodiment, an average (e.g. a weighted average, e.g. determined by a microphone location effect) of the signal strengths (here SS11, SS12) of the input transducers (here IT11, IT12) NOT located in or at the ear canal is determined. Alternatively other qualifiers may be applied to the mentioned signal strengths (here SS11, SS12), e.g. a MAX-function, or a MIN-function.

Figure 2A:
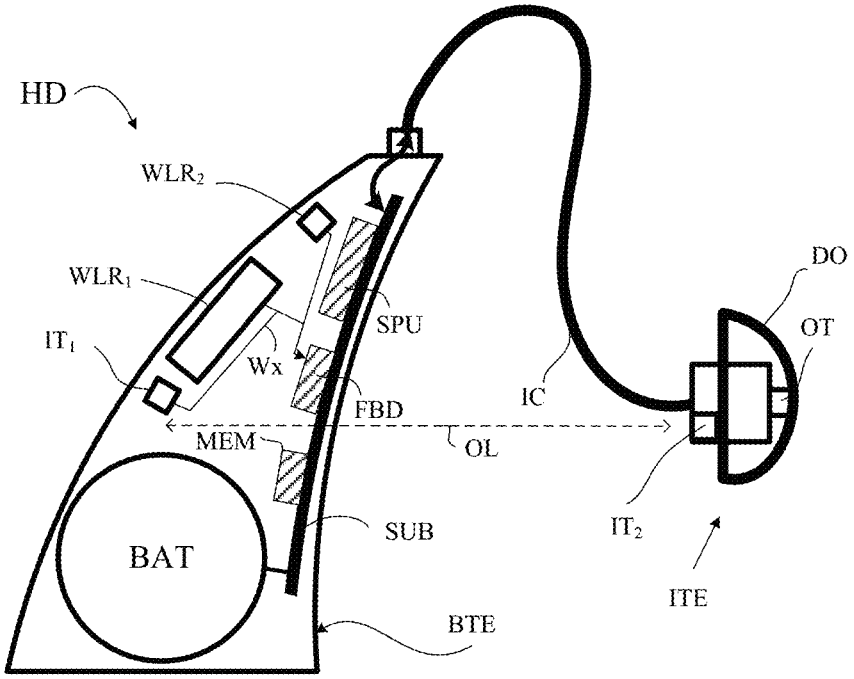
FIG. 2A shows a fifth embodiment of a hearing device according to the present disclosure.
Figure 2B:
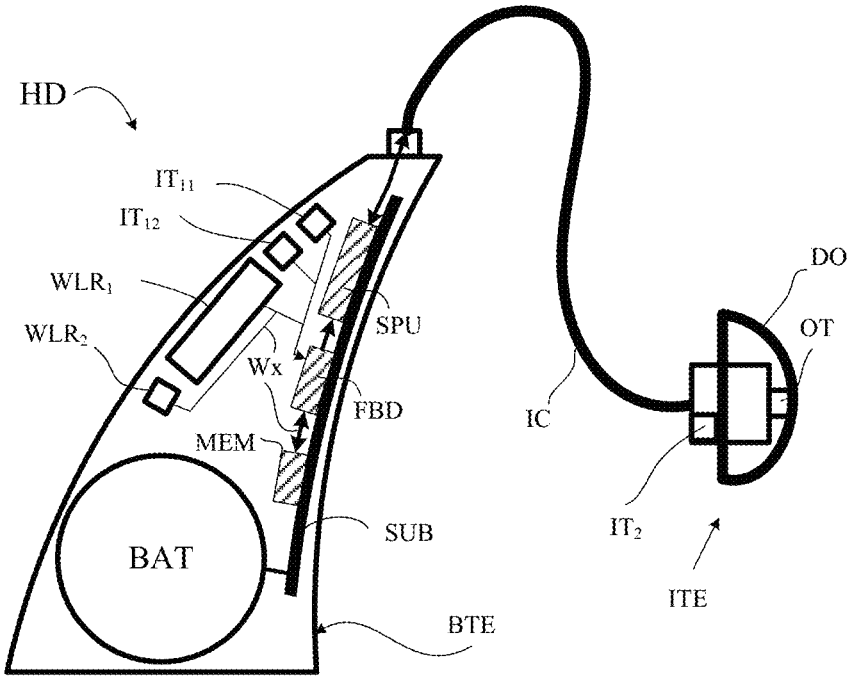
FIG. 2B shows a sixth embodiment of a hearing device according to the present disclosure.

FIGS. 2A and 2B each shows an exemplary hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising an output transducer (OT), e.g. a receiver (loudspeaker). The BTE-part and the ITE-part are connected (e.g. electrically connected) by a connecting element (IC) and internal wiring in the ITE- and BTE-parts (cf. e.g. schematically illustrated as wiring Wx in the BTE-part). The BTE- and ITE-parts each comprise an input transducer, which are used to pick up sounds from the environment of a user wearing the hearing device. In an embodiment, the ITE-part is relatively open allowing air to pass through and/or around it thereby minimizing the occlusion effect perceived by the user. In an embodiment, the ITE-part of a M2RITE-style according to the present disclosure is less open than a typical RITE-style comprising only a loudspeaker and a dome to position the loudspeaker in the ear canal. In an embodiment, the ITE-part of a M2RITE-style according to the present disclosure comprises a mould and is intended to allow a relatively large sound pressure level to be delivered to the ear drum of the user (e.g. a user having a severe-to-profound hearing loss).

In the embodiment of a hearing device (HD) in FIGS. 2A and 2B, the BTE part comprises an input unit comprising one or more input transducers (e.g. microphones) (in FIG. 2A, one, $IT_1$, and in FIG. 2B, two, $IT_{11}$, $IT_{12}$) each for providing an electric input audio signal representative of an input sound signal. The input unit further comprises two (e.g. individually selectable) wireless receivers ($WLR_1$, $WLR_2$) for providing respective directly received auxiliary audio input signals. The BTE-part comprises a substrate SUB whereon a number of electronic components (MEM, FBD, SPU) are mounted, including a memory (MEM) e.g. storing different hearing aid programs (e.g. parameter settings defining such programs) and/or input source combinations ($IT_1$, $IT_2$, $WLR_1$, $WLR_2$), e.g. optimized for a number of different listening situations. The BTE-part further comprises a feedback detector FBD for providing a feedback measure indicative of current acoustic feedback, The BTE-part further comprises a configurable signal processing unit (SPU) adapted to access the memory (MEM) and for selecting and processing one or more of the electric input audio signals and/or one or more of the directly received auxiliary audio input signals, based on a currently selected (activated) hearing aid program/parameter setting/ (e.g. either automatically selected based on one or more sensors and/or on inputs from a user interface). The configurable signal processing unit (SPU) provides an enhanced audio signal. In an embodiment, the signal processing unit (SPU), the feedback detector (FD) and the memory (MEM) all form part of an integrated circuit, e.g. a digital signal processor.

The hearing device (HD) further comprises an output unit (OT, e.g. an output transducer) providing an enhanced output signal as stimuli perceivable by the user as sound based on the enhanced audio signal from the signal processing unit or a signal derived therefrom. Alternatively or additionally, the enhanced audio signal from the signal processing unit may be further processed and/or transmitted to another device depending on the specific application scenario.

In the embodiment of a hearing device in FIGS. 2A and 2B, the ITE part comprises the output unit in the form of a loudspeaker (receiver) (OT) for converting an electric signal to an acoustic signal. The ITE-part also comprises a (second) input transducer ($IT_2$, e.g. a microphone) for picking up a sound from the environment as well as from the output transducer (OT). The ITE-part further comprises a guiding element, e.g. a dome, (DO) for guiding and positioning the ITE-part in the ear canal of the user.

The hearing device of FIG. 2A may represent an M2RITE style hearing aid containing two input transducers (IT1, IT2, e.g. microphones) adapted to provide that one (IT2, in the ITE-part) is located in or at the ear canal of a user and the other (IT1, in the ITE-part) elsewhere at the ear of the user (e.g. behind the ear (pinna) of the user), when the hearing device is operationally mounted on the head of the user. In the embodiment of FIG. 2A, the hearing device is configured to provide that the two input transducers (IT1, IT2) are located along a substantially horizontal line (OL) when the hearing device is mounted at the ear of the user in a normal, operational state (cf. e.g. input transducers IN1, IN2 and line OL in FIG. 2A). This has the advantage of facilitating beamforming of the electric input signals from the input transducers in an appropriate direction, e.g. in the 'look direction' of the user (e.g. towards a target sound source).

The embodiment of a hearing device shown in FIG. 2B comprises (e.g. three input transducers ($IT_{11}$, $IT_{12}$, $IT_2$). In the embodiment of FIG. 2B, the input unit is shown to contain exactly three input transducers ($IT_{11}$, $IT_{12}$, $IT_2$), two in the BTE-part ($IT_{11}$, $IT_{12}$) and one ($IT_2$) in the ITE part. In the embodiment of FIG. 2B, the two 'first' input transducers $IT_{11}$, $IT_{12}$ of the BTE-part are located in a typical state of the art BTE style, so that during wear of the hearing device, the two input transducers (e.g. microphones) are positioned along a horizontal line pointing substantially in a look direction of the user at the top of pinna (whereby the two input transducers in FIG. 2B can be seen as 'front' ($IT_{11}$) and 'rear' ($IT_{12}$) input transducers, respectively). The location of the three microphones has the advantage that a directional signal based on the three microphones can be flexibly provided.

The signal processing unit (SPU) comprises e.g. a feedback cancellation system for reducing or cancelling feedback from the output transducer (OT) to the (second) input transducer ($IT_2$) and/or to the (first) input transducer ($IT_1$) of the BTE-part. The feedback cancellation system may preferably be controlled or influenced by the feedback measure.

The hearing device (HD) exemplified in FIGS. 2A and 2B is a portable device and further comprises a battery (BAT), e.g. a rechargeable battery, for energizing electronic components of the BTE- and ITE-parts. The hearing device of FIGS. 2A and 2B may in various embodiments implement the embodiments of a hearing device shown in FIG. 1A, 1B, 1C, 1D, FIG. 5A, 5B, FIG. 6A, or 6B.

In an embodiment, the hearing device, e.g. a hearing aid (e.g. the signal processing unit SPU), is adapted to provide a frequency dependent gain and/or a level dependent compression and/or a transposition (with or without frequency compression) of one or frequency ranges to one or more other frequency ranges, e.g. to compensate for a hearing impairment of a user.

Figure 3:
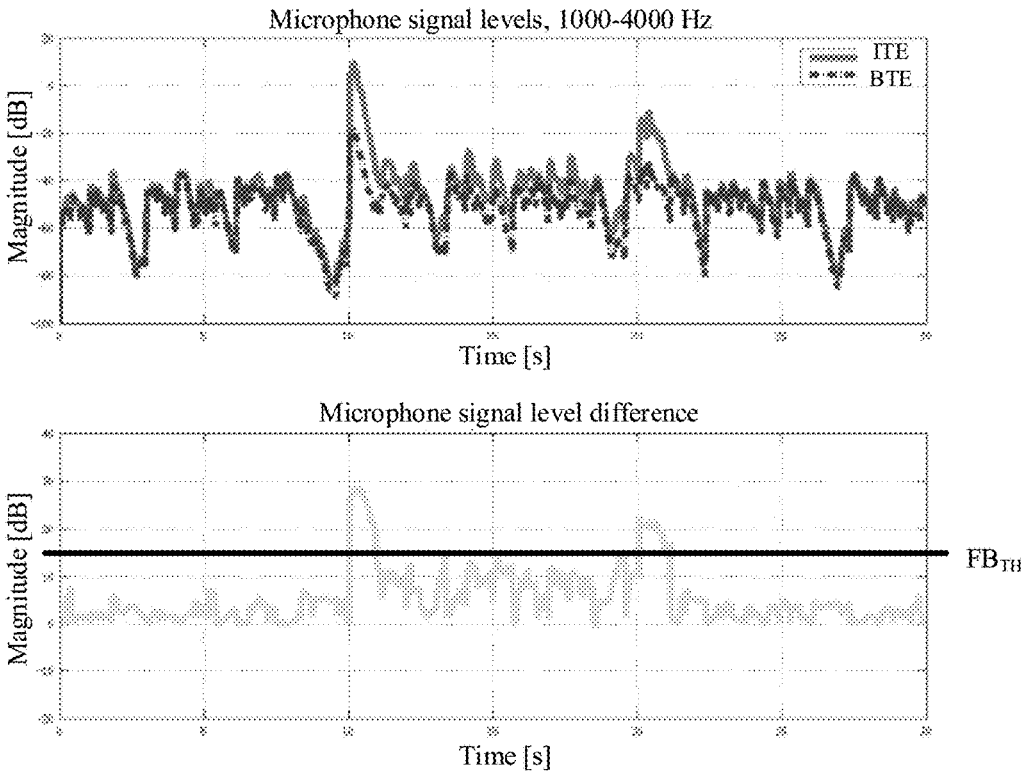
FIG. 3 shows in the upper part: plots of microphone signal levels (Magnitude [dB]) versus time (Time [s]) for a first microphone located in a BTE-part (solid line denoted BTE) and a second microphone located in an ITE-part (dash-dotted line denoted ITE) for a time period between 0 and 30 s, and in the lower part: a plot of the microphone signal level difference (solid line) between the first and second microphones of the upper part (Magnitude [dB]) versus time (Time [s]), FIG. 4A schematically illustrates the location of microphones relative to the ear canal and ear drum for a typical two-microphone BTE-style hearing aid, and FIG. 4B schematically illustrates the location of first and second microphones relative to the ear canal and ear drum for a two-microphone M2RITE-style hearing aid according to the present disclosure.

FIG. 3 shows in the upper part: plots of microphone signal levels (Magnitude [dB]) versus time (Time [s]) for a first microphone located in a BTE-part (solid line denoted BTE) and a second microphone located in an ITE-part (dash-dotted line denoted ITE) for a time period between 0 and 30 s, and in the lower part: a plot of the microphone signal level difference (solid line) between the first and second microphones of the upper part (Magnitude [dB]) versus time (Time [s]). The graphs in FIG. 3 exemplify a dynamic acoustic situation with time segments dominated by a target signal and time segments dominated by acoustic feedback. A feedback difference threshold $FB_{TH}$ (here at 15 dB) in the lower part of FIG. 3 indicates a possibly predetermined threshold between a listening situation dominated by acoustic feedback (level difference above $FB_{TH}$) and a listening situation not dominated by acoustic feedback (e.g. by a target signal in the acoustic far-field) (level difference below $FB_{TH}$). The detailed interpretation of the graphs is outlined in the below table, wherein the first column (Time (seconds)) refers to the time axis divided into five time segments reflecting different acoustic conditions, the second column (Feedback status) indicates a conclusion of the decision unit based on the level differences of the first and second microphone signals and the third and fourth columns refer to the details of the upper and lower plots, respectively, in the five different acoustic conditions.

| Time (seconds) | Feedback status | $1^{st}$ (BTE) and $2^{nd}$ (ITE) microphone signal levels (upper plot, dash-dotted and solid lines, respectively) | $1^{st}$ (BTE) and $2^{nd}$ (ITE) microphone signal level differences (lower plot, solid line) |
|---|---|---|---|
| 0-10 | No feedback | Both microphones at similar levels, dominated by the target incoming signal. | Typically <5 dB |
| 10-12 | Strong feedback | The ITE microphone signal has a much higher level than the BTE microphonesignal. Especially the ITE microphone signal is dominated by the feedback signal. | Typically >20 dB |
| 12-20 | Medium feedback | The ITE microphone signal has still higher level than the BTE microphone signal. | Typically around 5-10 dB |
| 20-22 | Strong feedback | The ITE microphone signal has a much higher level than the BTE microphone signal. Especially the ITE microphone signal is dominated by the feedback signal. | Typically >20 dB |
| 22-30 | No feedback | Both microphones at similar levels, dominated by the target incoming signal (far-field) | <5 dB |

Figure 4A:
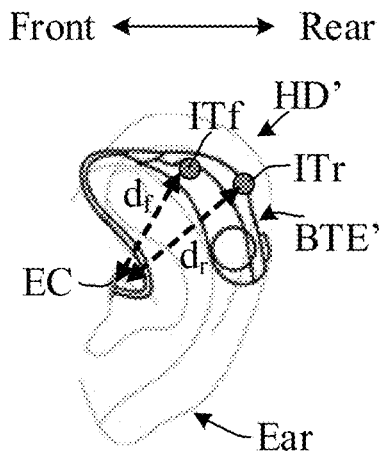

FIG. 4A schematically illustrates the location of microphones (ITf, ITr) relative to the ear canal (EC) and ear drum for a typical two-microphone BTE-style hearing aid (HD'). The hearing aid HD' comprises a BTE-part (BTE') comprising two input transducers (ITf, ITr) (e.g. microphones) located (or accessible for sound) in the top part of the housing (shell) of the BTE-part (BTE'). When mounted at (behind) a user's ear (Ear), the microphones (ITf, ITr) are located so that one (ITf) is more facing the front (cf. arrow denoted Front in FIG. 4A) and one (ITr) is more facing the rear of the user (cf. arrow denoted Rear in FIG. 4A). The two microphones are located a distance df and dr, respectively, from the entrance of the ear canal (EC). The two distances are of similar size (within 50%) of each other.

Figure 4B:
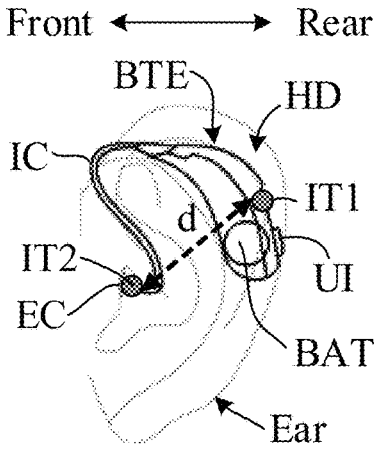

FIG. 4B schematically illustrates the location of first and second microphones (IT1, IT2) relative to the ear canal (EC) and ear drum for a two-microphone M2RITE-style hearing aid (HD) according to the present disclosure. One microphone (IT2) is located (in an ITE-part) at the ear canal entrance (EC) or retracted from the ear canal opening in a direction towards the eardrum. Another microphone (IT1) is located in or on a BTE-part (BTE) located behind an ear (Ear) of the user. The first microphone (IT1) is more facing towards the rear of the user (cf. arrow denoted Rear in FIG. 4B), whereas the second microphone (IT2) is more facing towards the front of the user (cf. arrow denoted Front in FIG. 4B). The distance between the two microphones (IT1, IT2) is indicated by d. The distance from the ear canal (EC) to the individual microphones (IT2, IT1) is thus ≈0 and d, respectively (the difference in distance to the ear canal entrance (EC) thus being d). Hence, a substantial difference in signal level (or power or energy) received by the first and second microphones (IT1, IT2) from a sound source located near the ear canal entrance (EC) (here e.g. from an output transducer of the hearing aid located in the ear canal (EC)) will be experienced. The hearing aid (HD), here the BTE-part (BTE), is shown to comprise a battery (BAT) for energizing the hearing aid, and a user interface (UI), here a switch or button on the housing of the BTE-part. The user interface is e.g. configured to allow a user to influence functionality of the hearing aid. It may alternatively (or additionally) be implemented in a remote control device (e.g. as an APP of a smartphone or similar device).

Figure 5A:
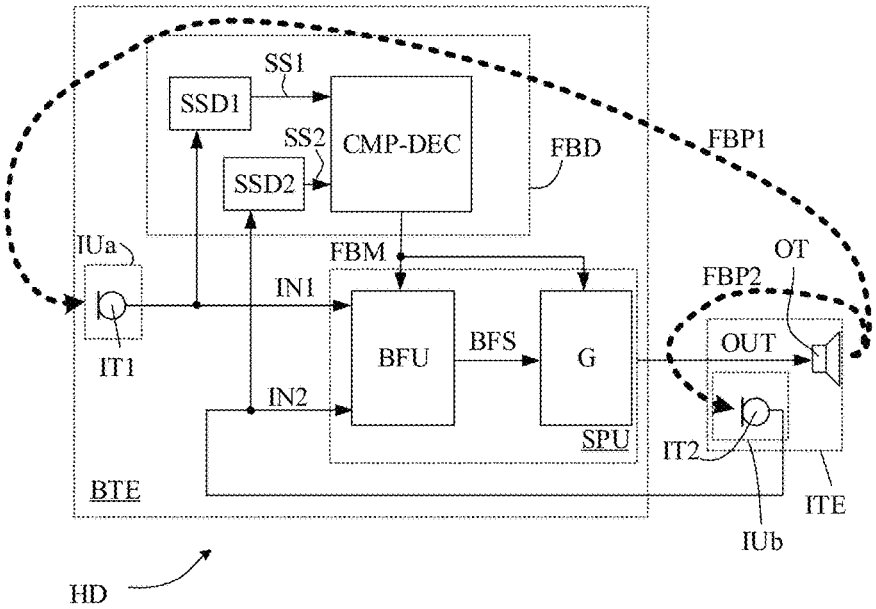
FIG. 5A shows an embodiment of a hearing device according to the present disclosure illustrating a use of the feedback measure in connection with a beamformer unit and a gain amplification unit.
Figure 5B:
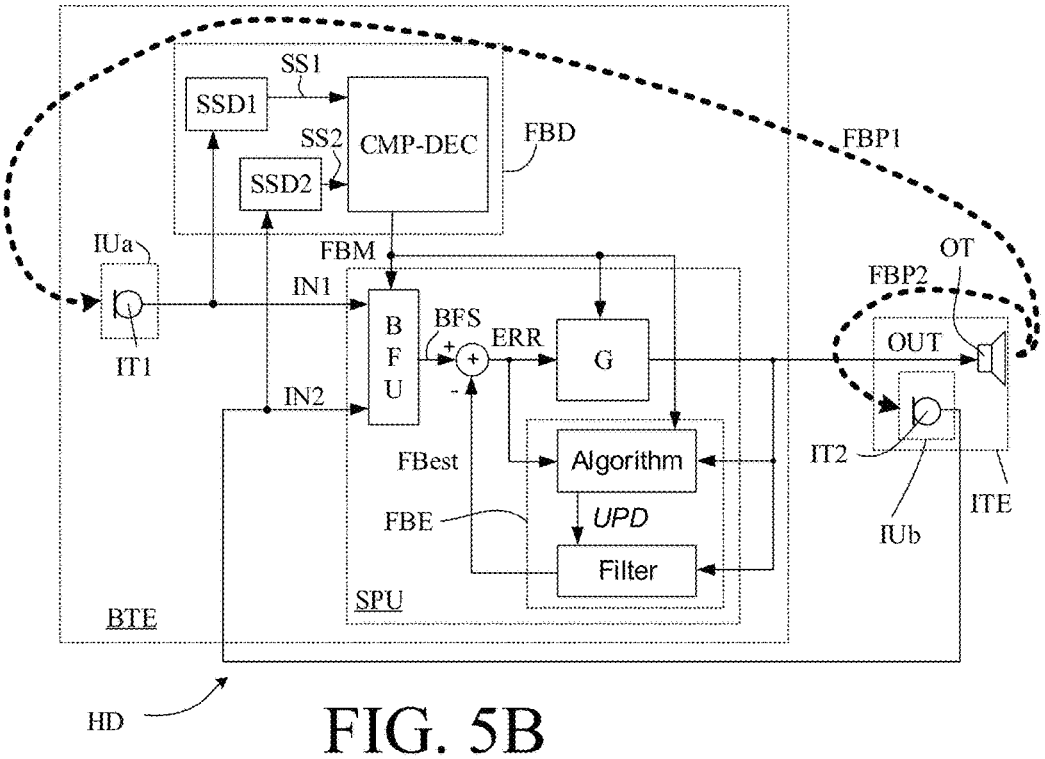
FIG. 5B shows an embodiment of a hearing device as shown in FIG. 5A additionally illustrating a use of the feedback measure in connection with a feedback cancellation system.

FIGS. 5A and 5B show two embodiments of a hearing device (HD) according to an aspect of the present disclosure. The hearing devices, e.g. hearing aids, are adapted for being arranged at least partly on or in a user's head. In the embodiments of FIGS. 5A and 5B, the hearing device comprises a BTE part (BTE) adapted for being located behind an ear (pinna) of a user. The hearing device further comprises an ITE-part adapted for being located in an ear canal of the user. The ITE-part comprises an output transducer (OT), e.g. a receiver/loudspeaker, and an input transducer (IT2), e.g. a microphone. The BTE-part is operationally connected to the ITE-part (cf. e.g. signal OUT). The embodiments of a hearing device shown in FIGS. 5A and 5B comprise the same functional parts as the embodiment shown in FIG. 1C, except that the BTE-part of the embodiments of FIGS. 5A and 5B only comprise one input transducer (IT1).

In the embodiment of FIG. 5A, the signal processing unit SPU of the BTE-part comprises a beamforming unit for applying (e.g. complex valued, e.g. frequency dependent) weights to the first and second electric input signals IN1 and IN2, providing a (e.g. complex) weighted combination (e.g. a weighted sum) of the input signals and providing a resulting beamformed signal BFS. The beamformed signal is fed to gain control unit G for further enhancement (e.g. noise reduction, feedback suppression, amplification, etc.). The feedback paths from the output transducer (OT) to the respective input transducers IT1 and IT2, are denoted FBP1 and FBP2, respectively (cf. bold, dotted arrows). The feedback signals are mixed with respective signals from the environment (when picked up by the input transducers). In a normal situation (considering the location of the output transducer relative to the input transducers), the feedback signal at the (second) input transducer IT2 of the ITE-part will be far larger than the feedback signal arriving at the (first) input transducer IT1 of the BTE part. This difference is utilized to identify feedback as described in the present disclosure. The beamformer unit (BFU), however, may comprise first (far-field) adjustment units configured to compensate the electric input signals IN1, IN2 for the different location relative to an acoustic source from the far field (e.g. according to the microphone location effect (MLE)). The first input transducer is e.g. arranged in the BTE-part to be located behind the pinna (e.g. at the top of pinna), whereas the second input transducer is located in or around the entrance to the ear canal. Thereby a maximum directional sensitivity of the beamformed signal may be provided in a direction of a target signal from the environment. Similarly, the beamformer unit (BFU) may comprise second (near-field) adjustment units to compensate the electric input signals IN1, IN2 for the different location relative to an acoustic source from the near-field (e.g. from the output transducer located in the ear canal). Thereby a minimum directional sensitivity of the beamformed signal may be provided in a direction of the output transducer.

The hearing device, e.g. feedback detection unit (FBD), is configured to control the beamformer unit (BFU) and/or the gain control unit in dependence of the feedback measure (FBM). In an embodiment, one or more weights of the weighted combination of electric input signals IN1, IN2 or signals derived therefrom is/are changed in dependence of the feedback measure FBM, e.g. in that the weights of the beamformer unit are changed to change en emphasis of the beamformer unit from one electric input signal to another in dependence of the feedback measure. In an embodiment, the feedback detection unit (FBD) is configured to control the beamformer unit to increase the weight of the first electric signal IN1 in the beamformed signal BFS in case the feedback difference measure indicates that the current acoustic situation is dominated by feedback (e.g. $|SS2-SS1|>FB_{TH}$, see e.g. FIG. 3).

The hearing device, e.g. feedback detection unit (FBD), may further be configured to control the gain control unit in dependence of the feedback measure. In an embodiment, the hearing device is configured to decrease the applied gain based on an indication by the feedback detector that the current acoustic situation is dominated by feedback.

In the embodiment of FIG. 5B, the hearing device comprises the same functional elements as shown and described in connection with FIG. 5A. In addition, the BTE-part of the embodiment of FIG. 5B comprises a feedback suppression (cancellation) system comprising a feedback estimation unit (FBE). The feedback estimation unit (FBE) comprises an adaptive filter comprising an adaptive algorithm part (Algorithm) for determining update filter coefficients, which are fed (signal UPD) and applied to a variable filter part (Filter) of the adaptive filter. The feedback suppression system further comprises a combination unit (+) wherein an estimate of the current feedback path FBest is subtracted from the resulting input signal BFS from the beamformer unit (BFU) and the resulting (feedback reduced) 'error' signal ERR is fed to the gain control unit G for further processing and to the algorithm part of the adaptive filter of the FBE-unit for use in the estimation of the feedback path. The feedback estimation unit (FBE) provides the estimate FBest of a current feedback path based on the output signal OUT from the signal processing unit and the error signal ERR (in that the adaptive algorithm minimizes the error signal ERR given the current output signal OUT). In the shown embodiment, the hearing device uses the feedback measure signal FBM from the feedback detector (FBD) to control the feedback estimation unit (FBE), e.g. its adaptation rate (including whether or not filter coefficients of the variable filter part (Filter) should be updated). In other embodiments, each of the input transducers (microphones) (IT1, IT2) have their own feedback suppression system (as e.g. illustrated in FIG. 6A, 6B), in which case feedback correction via combination units ('+') is performed before beamforming is applied.

In FIGS. 5A and 5B, the beamformer unit BFU is located in the forward path before the combination unit (+), where the feedback estimate signal FBest from the feedback estimation unit (FBE), specifically from the variable filter part (Filter), is subtracted from the beamformed signal BFS to provide a feedback corrected (error) signal ERR. In other embodiments (as e.g. indicated in FIG. 6A, 6B), the beamformer unit (BFU) (possibly forming part of signal processing unit SPU), is located in the forward path after the combination unit(s) (+). This requires—on the other hand—that a feedback estimation unit FBE and corresponding combination unit is provided for each of the input transducers (IT1, IT2 in FIG. 6A, 6B), as illustrated in FIGS. 6A and 6B by feedback estimation units FBE1, FBE2.

The embodiments of FIGS. 5A and 5B may be operated fully or partially in the time domain, or fully or partially in the time-frequency domain (by inclusion of appropriate time-to-time-frequency and time-frequency-to-time conversion units).

Figure 6A:
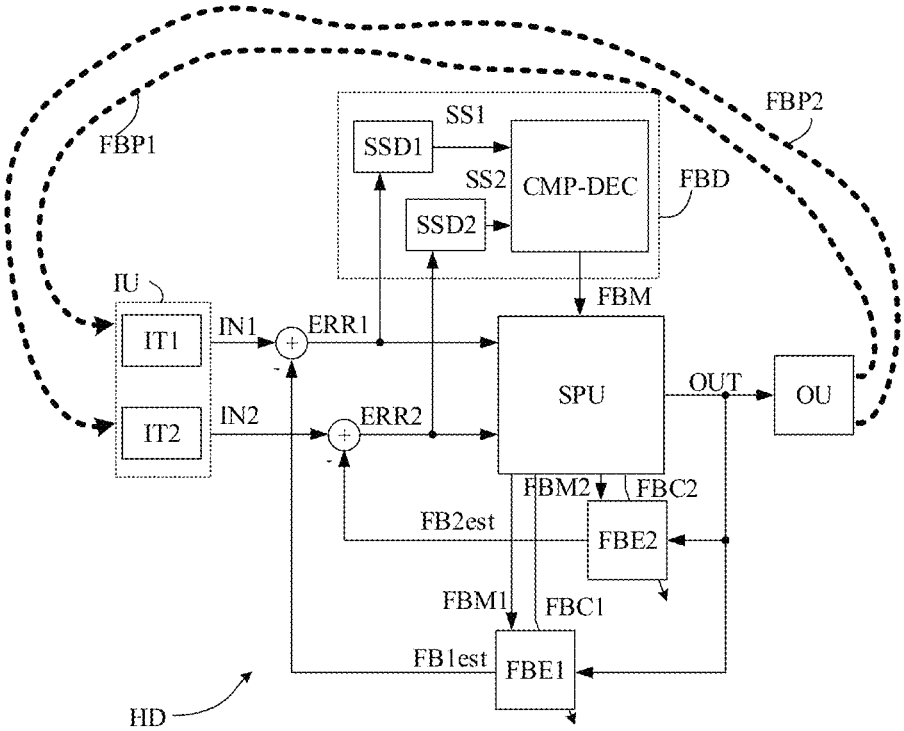
FIG. 6A shows an embodiment of a hearing device according to the present disclosure comprising a first feedback cancellation system.
Figure 6B:
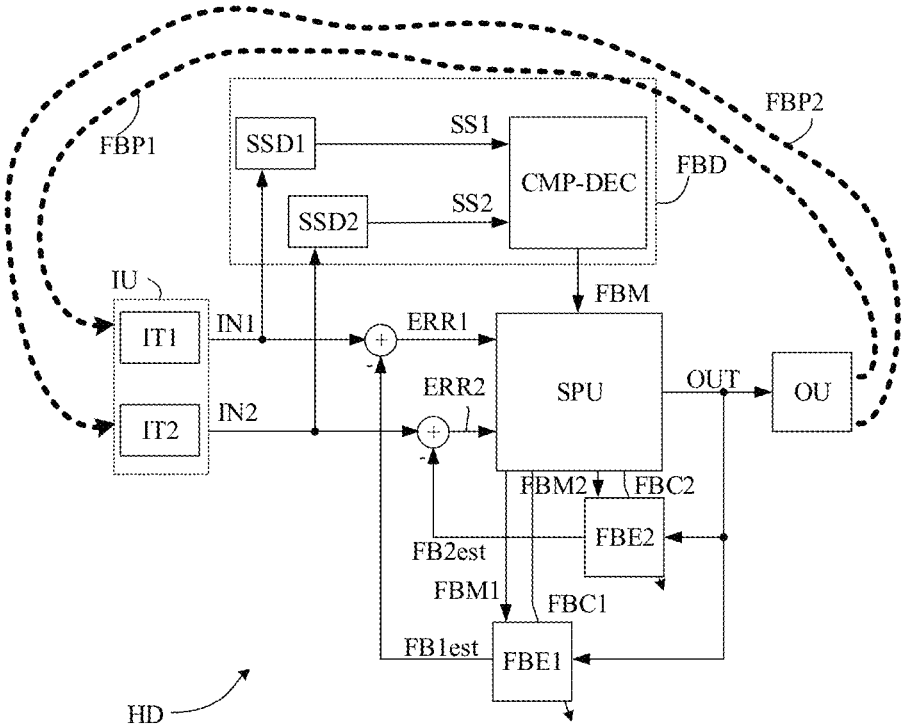
FIG. 6B shows an embodiment of a hearing device according to the present disclosure comprising a second feedback cancellation system, FIG. 7A schematically illustrates a difference in level (L [dB]) over time (t [s]) between the second and first input transducers of a hearing device according to the present disclosure.

FIG. 6A shows an embodiment of a hearing device according to the present disclosure comprising a first feedback cancellation system, and FIG. 6B shows an embodiment of a hearing device according to the present disclosure comprising a second feedback cancellation system.

In the embodiment of a hearing device shown in FIG. 5B only a single feedback estimation unit and associated combination unit ('+') is indicated (working on the beamformed input signal BFS from the beamformer unit (BFU)). FIG. 6A illustrates an embodiment of a hearing device as shown in FIG. 1A, but additionally comprising a (first) feedback cancellation system (one for each input transducer), wherein combination units (sum-units '+') for compensating the respective electric input signals INi from input transducers ITi with estimate signals FBiest of the corresponding feedback paths (FBPi) (i=1, 2) are located before the signals (here ERRi) to the signal strength estimators (SSDi) have been tapped off. Each feedback input transducer ITi (i=1, 2) has its separate feedback cancellation system comprising a feedback estimation unit FBEi providing estimate signals FBEiest representing estimates of the respective feedback paths and a combination unit ('+') for subtraction the feedback path estimate signal FBEiest from the electric input signal INi and providing a resulting feedback corrected input signal ERRi (often termed the 'error signal'). The feedback path estimate signals FBEiest are based on the output signal (OUT) and respective control signals (FBCi) from the signal processing unit (SPU) (e.g. based on the error signal ERRi). In the embodiments of FIGS. 6A and 6B, each of the feedback estimation units FBEi (i=1, 2) receives a further control input FBMi (i=1, 2) from the signal processing unit (SPU), e.g. based on the feedback measure FBM from the feedback detector (FBD) to control parameters of the respective feedback estimation units, e.g. an update frequency, an adaptation rate, an activation or deactivation, etc.

The embodiment of FIG. 6B is equivalent to the embodiment of FIG. 6A apart from the location of the combination units ('+') of the feedback cancellation systems relative to where the signals (in FIG. 6B, INi) to the signal strength estimators SSDi have been branched off. In the embodiment of FIG. 6B, the combination units ('+') are located in the respective electric input signal paths after the signals (here INi) to the signal strength estimators (SSDi) are branched off.

The embodiments of FIGS. 6A and 6B may be operated fully or partially in the time domain, or fully or partially in the time-frequency domain (by inclusion of appropriate time-to-time-frequency and time-frequency-to-time conversion units).

Figure 7A:
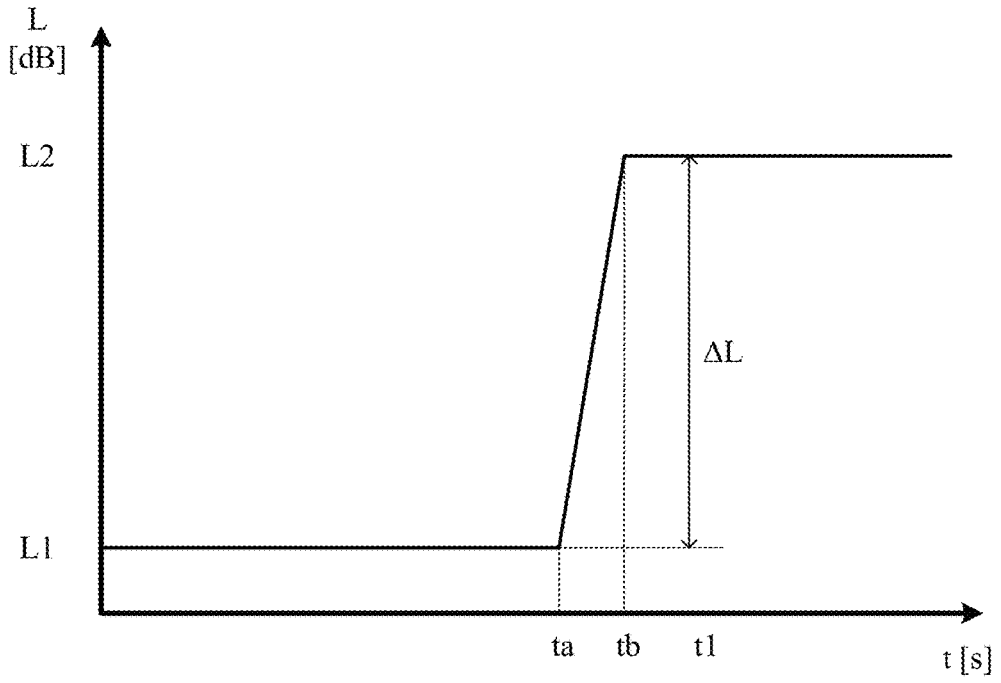
FIG. 7B schematically illustrates a difference in level (L [dB]) over frequency (f [Hz]) at a given point in time (t1 in FIG. 7A) between the second and first input transducers of a hearing device according to the present disclosure, and FIG. 8A schematically illustrates the use of the feedback measure to determine an appropriate weighting of electric input signals in a number frequency bands.

FIG. 7A schematically illustrates a difference in level (L [dB]) over time (t [s]) between the second and first input transducers of a hearing device according to the present disclosure. A situation, where a change in the feedback situation from a 'feedback not dominant' (before time ta) to a feedback dominant' situation (after time tb) is illustrated. A significant change in level difference ΔL occurs between time ta and tb. For a configuration of input transducers of an M2RITE style hearing device according to the present disclosure (e.g. as shown in FIG. 2A or 2B), a level difference in the range from 15-25 dB between two electric signals from input transducers located at or in an ear canal and at or behind an ear of a user, respectively, indicates that the hearing device is located in the near-field of a sound source, most likely the loudspeaker of the hearing device itself (and thus indicates a situation dominated by feedback).

Figure 7B:
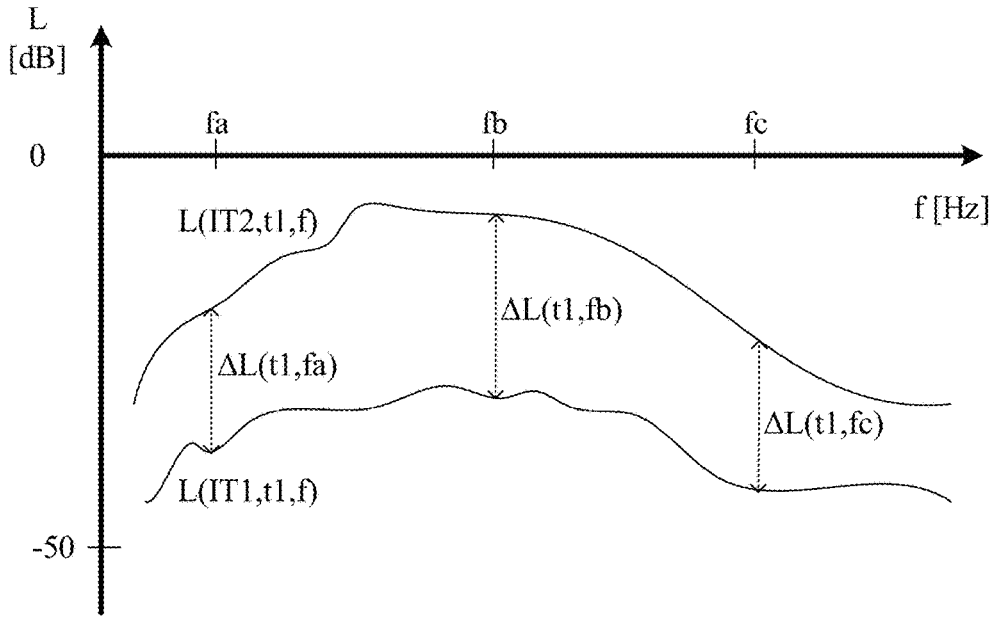

FIG. 7B schematically illustrates a difference in level (L [dB]) over frequency (f [Hz]) at a given point in time (t1 in FIG. 7A) between the second and first input transducers of a hearing device according to the present disclosure. Measured or estimated levels L of first and second electric input signals provided by first and second input transducers (e.g. microphones), IT1, and IT2, respectively, versus frequency f are schematically shown in FIG. 7B. The signals have levels L(IT1, t1, f) and L(IT2, t1, f), respectively, within a range from 0 dB to −50 dB and have a difference in level ΔL(t1, f) between them around 15-25 dB. Level differences ΔL(t1, f) at time t1 are indicated in FIG. 7B at three different frequencies fa, fb and fc.

The frequency (and time) dependent level differences Δ(f,t) between the input transducers (e.g. IT2 and IT1 of FIG. 1B) may be averaged or otherwise processed (e.g. using MIN- or MAX- or MEDIAN-functions) before a decision is taken by the comparison and decision unit of the feedback detector (resulting in a 'feedback dominant' or a 'feedback not dominant' value of the feedback measure signal FBM is decided. In an embodiment, the feedback measure signal FBM is provided in a number of frequency bands (e.g. Nb as in FIG. 1B) and thus may result in different values of the feedback measure signal FBM in different frequency bands (e.g. resulting in a 'feedback dominant' value in one frequency band and a 'feedback not dominant' value in another frequency band (at a given point in time)). The control of a feedback estimation unit (FBE) and/or of a gain control unit (G) may accordingly be different in different frequency bands.

Figure 8A:
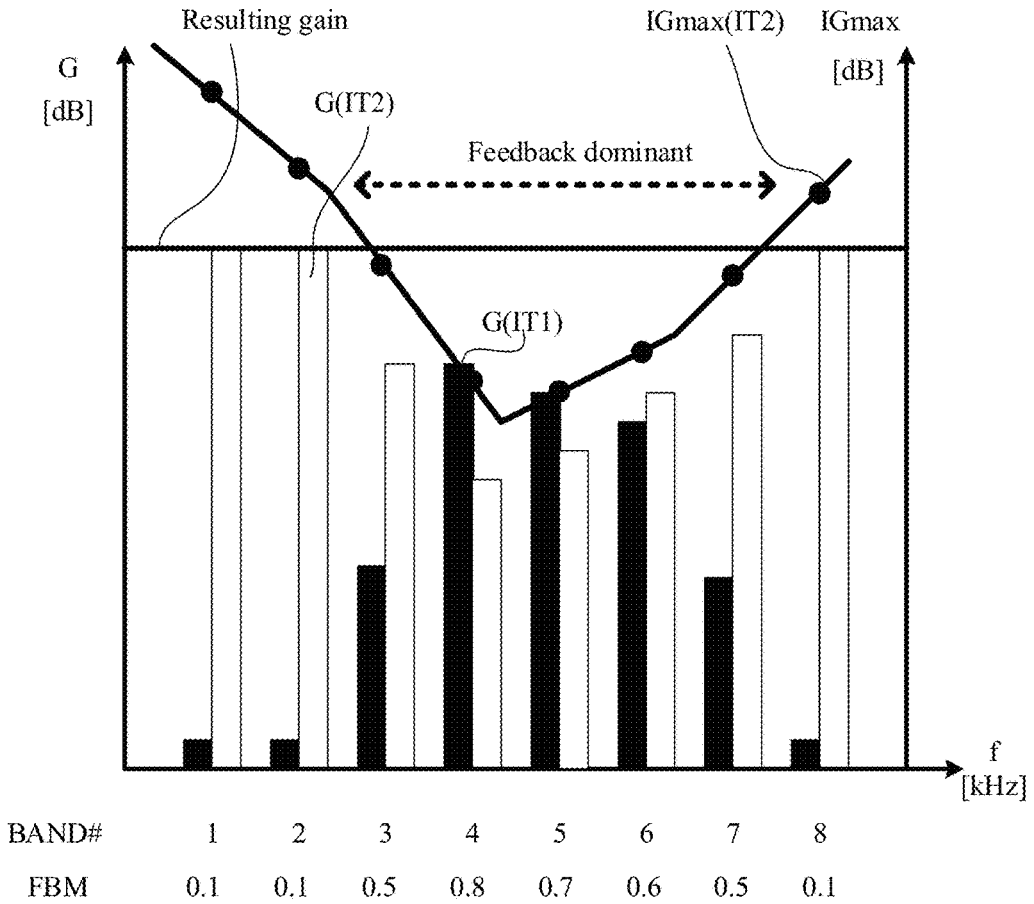
FIG. 8B shows an embodiment of a hearing device according to the present disclosure suitable for implementing the weighting scheme of FIG. 8A.

FIG. 8A schematically illustrates the use of the feedback measure to control weights of a beamformer in a number frequency bands. The feedback measure FBM, which (in this embodiment) takes on values in the interval between 0 and 1, is shown as a function of frequency f or frequency bands BAND# (1-8). Eight frequency bands are assumed to span the relevant frequency range (e.g. between 0 and 8 kHz). Any other number of frequency bands may be used, e.g. 16 or 64 or more. A value of FBM equal to or above 0.5 is taken to indicate an acoustic situation wherein feedback is dominant. A value of FBM below 0.5 is taken to indicate an acoustic situation wherein feedback is NOT dominant. The top, piecewise linear graph schematically illustrates a maximum allowable gain IGmax(IT2) for the second input transducer IT2 (e.g. located in or at an ear canal of the user). IGmax depends on the hearing aid style, and the current feedback (and a feedback margin). A frequency range where feedback is dominant is indicated in FIG. 8A by a dotted double arrow denoted 'Feedback dominant' (covering bands 3-7, e.g. corresponding to a frequency range between 2 and 4 kHz). In this frequency range, the maximum allowable gain IGmax(IT2) is decreased (to avoid that loop gain (=IGmax+FB, in logarithmic representation, FB being feedback gain) becomes too large which may result in howl. The frequency range where feedback is dominant is further indicated by the feedback measure FBM being larger than or equal to 0.5 (see lower part of FIG. 8A). A requested resulting gain of the second input transducer IT2 is schematically indicated by the solid line denoted 'Resulting gain'. The frequency dependent control of the weights of the first and second input transducers IT1, IT2, respectively, as contributers to a beamformed signal (BFS in FIG. 5A, 5B) is indicated in FIG. 8A by the bar diagram in the middle of FIG. 8A, where a value of the frequency dependent gain is indicated. The black bar illustrates a gain G(IT1,f) applied to the signal from the first input transducer IT1 (the first electric input signal), and the white bar illustrates a gain G(IT2,f) applied to the signal from the second input transducer IT2 (the second electric input signal). In frequency bands NOT dominated by feedback (Band#1, 2 and 8), emphasis is given to the second (ear canal) electric input signal providing the full requested gain. In frequency bands dominated by feedback (Band#3-7), emphasis is moved from the signal from the second to the signal from the first input transducer in that gain G(IT2) applied to the signal from the second (ear canal) input transducer IT12 is reduced to a value providing a predefined margin to the maximum allowable gain IGmax(IT2) and the gain G(IT1) applied to the signal from the first input transducer IT1 is increased to compensate for the reduction in gain G(IT2). Thereby a flexible and robust system that utilizes the advantages of the location of the second input transducer (e.g. in the ear canal) in acoustic situations where feedback is absent (or NOT dominant), and avoids howl in acoustic situations dominated by feedback (to the second input transducer) by increasing emphasis of the signal from the first input transducer (e.g. located behind an ear of the user). This strategy based on the feedback measure FBM provided by the feedback detector (FBD) may be used on a broadband (time-domain) signal as well as on a band split (time-frequency domain) signal as schematically illustrated in FIG. 8A.

Figure 8B:
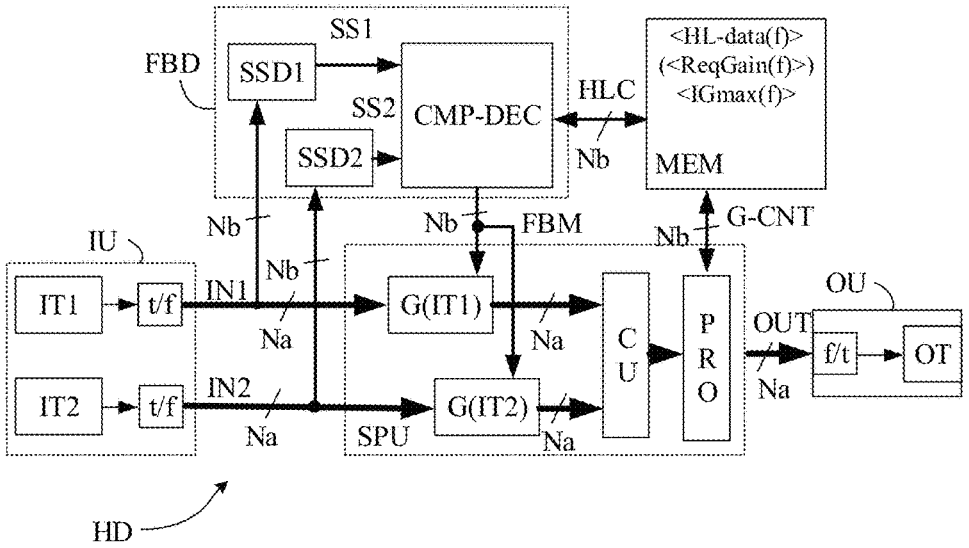

FIG. 8B shows an embodiment of a hearing device (HD) according to the present disclosure suitable for implementing the weighting scheme of FIG. 8A. The embodiment of a hearing device of FIG. 8B is equivalent to the embodiment shown and discussed in connection with FIG. 1B. Additionally, the feedback detector comprises a feedback manager comprising a memory (MEM) wherein frequency dependent hearing loss data (<HL-data> in FIG. 8B) (and/or a requested frequency dependent gain IG(f) derived therefrom) for the user are stored. Additionally, measured or (e.g. dynamically) estimated frequency dependent maximum allowable gain data (<IGmax(f)> in FIG. 8B) are stored (e.g. based on the current hearing aid style, feedback path estimates, etc.). The feedback detection unit (FBD) is in communication with the memory (MEM) via signal HLC allowing the feedback detection unit to read from and write to the memory. Based on the current values of the feedback measure FBM (see e.g. bottom part of FIG. 8A), the currently stored values of IGmax (which may be predefined, or dynamically updated), and the presently determined resulting gains (cf. FIG. 8A (typically frequency dependent, though) based on the current input signal, user dependent gain data (ReqGain(f)) (and possibly applied processing algorithms), the 'emphasis gain values' (cf. bar diagram in FIG. 8A) applied to the electric input signals IN1, IN2, can be determined and applied in the input signal gain units G(IT1) and G(IT2), respectively. The signal processing unit (in addition to the input signal gain units) comprise a combination unit (CU, e.g. a SUM unit or a weighted SUM unit (e.g. a beamformer unit, BFU) providing a resulting input signal (e.g. a beamformed signal, BFS), and possibly a processing unit (PRO) for applying further processing algorithms (e.g. noise reduction and/or feedback reduction) to the signal of the forward path and providing processed output signal OUT. The processing unit (PRO) is in communication with the memory (MEM) via signal G-CNT allowing the processing unit to read from and write to the memory. As also indicated in FIG. 1B, FIG. 8B is assumed to operate fully or partially in the time-frequency domain. The embodiment of FIG. 8B may e.g. comprise a feedback cancellation system, e.g. as shown in embodiments of FIGS. 5B, 6A and 6B.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2843971A1 (OTICON) Apr. 3, 2015

The invention claimed is:

1. A hearing device adapted for being arranged at least partly on a user's head or at least partly implanted in a user's head, the hearing device comprising an input unit for providing a multitude of electric input signals representing sound, a signal processing unit providing a processed signal based on one or more of said multitude of electric input signals, and an output unit comprising an output transducer for converting said processed signal or a signal originating therefrom to a stimulus perceivable by said user as sound;

the input unit comprising a first input transducer for picking up a sound signal from the environment and providing a first electric input signal, the first input transducer being located on the head of the user;

a second input transducer for picking up a sound signal from the environment and providing a second electric input signal, the second input transducer being located at or in an ear canal of the user, the hearing device further comprising a feedback detector comprising a first signal strength detector for providing a signal strength estimate of the first electric input signal for each of a plurality of frequency bands, and a second signal strength detector for providing a signal strength estimate of the second electric input signal for each of the plurality of frequency bands, a comparison unit operationally coupled to the first and second signal strength detectors and configured to compare the signal strength estimates of the first and second electric input signals and to calculate a difference between said signal strength estimates of the first and second electric input signals as a signal strength comparison measure for each of the plurality of frequency bands;

a weighting unit comprising a mixer or a beamformer unit, the mixer or beamformer unit providing a mixed or beamformed signal based on a weighted combination of said multitude of electric input signals or signals derived therefrom, wherein the hearing device is configured to control the weights applied by the mixer or beamformer unit on the first and second electric input signals or signals derived therefrom in dependence of the signal strength comparison measure calculated from the signal strength estimates of the first and second electric input signals for each of the plurality of frequency bands, such that the weight of the first electric input signal is increased and/or the weight of the second electric input signal is decreased in the mixed or beamformed signal in each of the plurality frequency bands in which the signal strength comparison measure indicates that the current acoustic situation is dominated by feedback.

2. A hearing device according to claim 1 comprising a BTE-part adapted to be worn at or behind an ear of a user, and an ITE-part adapted to be located at or in an ear canal of the user.

3. A hearing device according to claim 2, wherein the first input transducer is located in the BTE-part, and wherein the second input transducer is located in the ITE-part.

4. A hearing device according to claim 1 comprising a time to time-frequency conversion unit allowing the processing of signals in the (time-) frequency domain.

5. A hearing device according to claim 1 wherein the feedback detector further comprises:

a decision unit for providing a feedback measure indicative of current acoustic feedback from said output transducer to said first and/or second input transducer based on said signal strength comparison measure for each of the plurality of frequency bands, and wherein the hearing device is configured to control the weights applied by the mixer or beamformer unit in dependence of the feedback measure for each of the plurality of frequency bands.

6. A hearing device according to claim 5 wherein the decision unit is configured to apply a feedback difference threshold to make a binary distinction between a feedback dominant and non-feedback dominant acoustic situation.

7. A hearing device according to claim 6 wherein the feedback difference threshold is predetermined.

8. A hearing device according to claim 6 wherein the feedback difference threshold is between 5 dB and 25 dB.

9. A hearing device according to claim 1 comprising a feedback cancellation system for reducing the acoustic or mechanical feedback from the output transducer to the first and/or second input transducer, and wherein the feedback measure indicative of the amount of acoustic feedback is used to control the feedback cancellation system.

10. A hearing device according to claim 5 comprising a gain control unit, and wherein the hearing device is configured to control the gain control unit in dependence of the feedback measure.

11. A hearing device according to claim 5 comprising a configurable de-correlation unit for increasing a de-correlation between an output signal from the hearing device and an input signal to the hearing device, and wherein the hearing device is configured to control the de-correlation unit depending on the feedback measure.

12. A hearing device according to claim 11 wherein the configurable de-correlation unit is configured to introduce a frequency shift in the forward path of the hearing device.

13. A hearing device according to claim 11 configured to control the configurable de-correlation unit, including at least one of its activation, its de-activation and the amount of de-correlation depending on the feedback measure.

14. A hearing device according to claim 2 comprising three input transducers wherein two, first, input transducers are located in the BTE-part and one, second, input transducer is located in the ITE part.

15. A hearing device according to claim 1 comprising a hearing aid, a headset, an active ear protection device or a combination thereof.

16. A hearing device according to claim 1 wherein the output transducer comprises a loudspeaker for providing said stimulus as an acoustic signal to the user, and/or a vibrator for providing the stimulus as mechanical vibration of a skull bone to the user.

17. Use of a hearing device as claimed in claim 1 as a hearing aid.

* * * * *